US006173680B1

(12) United States Patent
Dague et al.

(10) Patent No.: US 6,173,680 B1
(45) Date of Patent: Jan. 16, 2001

(54) STEAM GENERATOR COMPRISING AN IMPROVED FEEDWATER SUPPLY DEVICE

(75) Inventors: Gilles Dague, Paris; Guy Desfontaines-Leromain, Puteaux; Daniel Destré, Aulnay Sous Bois, all of (FR)

(73) Assignee: Framatome, Courbevoie (FR)

( * ) Notice: Under 35 U.S.C. 154(b), the term of this patent shall be extended for 0 days.

(21) Appl. No.: 09/300,405

(22) Filed: Apr. 27, 1999

(30) Foreign Application Priority Data

May 4, 1998 (FR) ..... 98 05620
May 7, 1998 (FR) ..... 98 05843

(51) Int. Cl.[7] ..... F22D 1/30
(52) U.S. Cl. ..... 122/441; 122/32; 122/467
(58) Field of Search ..... 122/1 C, 31.1, 122/32, 235.15, 249, 367.1, 360, 414, 441, 444, 459, 467, 468

(56) References Cited

U.S. PATENT DOCUMENTS 4,357,908 * 11/1982 Yazidjian ..... 122/32
4,429,663 * 2/1984 Dorner et al. ..... 122/32
5,329,886 7/1994 Sylvester et al. .
5,335,629 * 8/1994 Cornic ..... 122/32
5,347,959 * 9/1994 Slama et al. ..... 122/32
5,396,948 * 3/1995 Poussin ..... 122/32

FOREIGN PATENT DOCUMENTS 0 547 967 6/1993 (EP) ..... F22B/37/22
2 700 383 7/1994 (FR) ..... F28F/9/00

* cited by examiner

*Primary Examiner*—Denise L. Ferensic
*Assistant Examiner*—Gregory A. Wilson
(74) *Attorney, Agent, or Firm*—Pollock, Vande Sande & Amernick, R.L.L.P.

(57) ABSTRACT

The steam generator comprises a cylindrical outer jacket (2) arranged with its axis vertical, a bundle wrapper (4) arranged coaxially with respect to the outer jacket and a space (9) in which feed water can flow between the bundle wrapper (4) and the outer jacket (2) or a guide skirt (8, 8*a*). A water supply device (10) placed towards the top of the space (9) in which the feedwater flows comprises a torus-shaped manifold (12), the upper wall of which is traversed by a number of flow openings (18) distributed in the circumferential direction of the manifold (12). A feed pipe (13) opens into the manifold and the feedwater is guided by a guide device towards the annular flow space (9). Radial dividing walls (19*a*, 19*b*, 19*c*, 19*d*) are arranged transversely in a water flow space delimited between the manifold (12) and the guide device (14).

6 Claims, 4 Drawing Sheets

STEAM GENERATOR COMPRISING AN IMPROVED FEEDWATER SUPPLY DEVICE

FIELD OF THE INVENTION

The invention relates to a steam generator, and in particular to a steam generator of a pressurized-water nuclear reactor comprising an improved feedwater supply device.

BACKGROUND OF THE INVENTION

Steam generators such as the steam generators, of pressurized-water-cooled nuclear reactors, comprise an outer jacket of cylindrical overall shape arranged vertically in the nuclear reactor building, i.e., with the axis of the outer jacket vertical.

The steam generators of pressurized-water nuclear reactors allow the feedwater to be heated and turned into steam by exchanging heat with the pressurized water that cools the nuclear reactor and which flows through the tubes of a heat-exchange bundle. The tube bundle is arranged inside a bundle wrapper of cylindrical overall shape which is arranged coaxially inside the outer jacket.

The tubes of the bundle are fixed at their ends into a tube plate so that they open, at a first end, into a first part of a water box of the steam generator, and at a second end, into a second part of the water box of the steam generator. The water box of the steam generator allows the pressurized water from the nuclear reactor vessel, in which the core which consists of fuel assemblies is arranged, to be distributed, and allows the pressurized water which has flowed through the heat-exchange tubes to be recovered, so that the recovered pressurized water can be sent back to the nuclear reactor vessel.

Steam generator feedwater is introduced into the outer jacket and is routed as far as an inlet part of the heat-exchange bundle, towards the bottom of the bundle and bundle wrapper. The feedwater then flows from the bottom upwards inside the bundle wrapper in contact with the external surface of the tubes, so that it heats up and vaporizes and ends up in the form of steam towards the top of the outer jacket of the steam generator. The steam recovered in the top of the steam generator is sent to the reactor turbine.

The feedwater is generally introduced into the top of an annular space formed between the tube bundle wrapper and the outer jacket or between the bundle wrapper and a skirt delimiting a flow space communicating with an end part of the bundle that consists of the ends of the cold legs of the tubes, i.e., the legs of the tubes via which the reactor cooling water exits once it has been used to heat the feedwater and turn it into steam.

By using a feed space delimited by a skirt, the feedwater can be preheated by flowing in contact with the bundle wrapper and in contact with the cold legs of the tubes, which legs are separated from the hot legs by a vertical dividing wall directed across a diameter over part of the height of the bundle.

In any event, the feedwater introduced into the steam generator jacket flows from top to bottom in an annular space directed vertically and axially as far as near the bottom of the bundle wrapper.

To achieve good steam generator efficiency and satisfactory operating conditions, it is necessary for the flow of feedwater to be distributed in the circumferential direction of the annular feed space of the steam generator.

To that end, it has been proposed that use be made of a manifold in the overall shape of a torus which is arranged inside the outer jacket of the steam generator vertically in line with the upper part of the annular feedwater supply space. The manifold is connected to a feedwater feed pipe passing through the outer jacket of the steam generator, and comprises means of distributing and guiding the feedwater, these means being spread out in the circumferential direction of the annular feedwater supply space. The means of distributing and guiding the feedwater may consist of tubes in the shape of an inverted J, the vertical straight leg of which is fixed to the manifold, and the loop of which points downwards, towards the upper part of the annular feed space. The distribution in the circumferential direction and the flow rate passing through each of the J-shaped tubes makes it possible to obtain a satisfactory distribution of the feedwater in the circumferential direction of the annular space. However, this device has the drawback that the jets emerge from the J-shaped tubes at high speed, which disturbs the flow of water making its way towards the annular feed space.

It has also been proposed that this feedwater supply device be adapted to steam generators with preheating that comprise an economizer consisting of a feedwater guide skirt communicating with the end of the cold legs of the tubes of the bundle. In this case, the guide skirt, which is in the shape of a cylindrical sector, delimits with the bundle wrapper an annular space that extends over a circular arc of less than 180° around the steam generator bundle wrapper. The manifold then consists of a portion of a torus extending over less than 180° around the bundle wrapper, vertically in line with the upper part of the annular feed space. This device has the same drawbacks as the device in which the manifold consists of a jacket in the shape of a complete torus completely surrounding the bundle wrapper, because the feedwater leaving the manifold is also distributed using J-shaped tubes. It has been proposed that the J-shaped tubes be extended in the vertical direction, inside the annular feedwater supply space. This arrangement does not, however, fully solve the problems of turbulence and makes the mechanical design of the steam generator more complicated on account of the length of the outlet legs of the J-shaped tubes.

U.S. Pat. No. 5,396,948 proposes that the feedwater supply manifold be a spillway consisting of a channel section in the overall shape of a torus which is open at its top, or in the overall shape of a portion of an open torus, combined with feedwater guide walls directed downwards in the upper part of the annular space. The feedwater is brought into the manifold, by a feed pipe passing through the outer jacket of the steam generator and opening into the manifold. The feedwater fills the channel-section manifold up to the level of a spillway edge over which the feedwater flows into a flow space delimited by the guide walls. The spillway to a certain extent distributes the flow of feedwater around the circumference of the annular space, but it is very difficult to determine precisely what this distribution will be as a function of the spillway feed conditions.

Another drawback of the device comprising a spillway is that it is not easy to ensure that the spillway will be durable enough when subjected to high mechanical stresses, of the water-hammer type, or in an accident situation, for example if a feedwater pipe were to burst. It is therefore necessary to design components with which to construct the distribution device which are extremely strong and are made from very thick sheeting.

SUMMARY OF THE INVENTION

The object of the invention is therefore to propose a steam generator comprising an outer jacket of cylindrical overall shape arranged with its axis vertical, a bundle of heat-exchange tubes fixed inside a bundle wrapper of cylindrical overall shape arranged coaxially inside the outer jacket so as to delimit with the outer jacket or a guide skirt coaxial with the outer jacket an annular space in which the feedwater for the steam generator can flow in the axial direction and a feedwater supply device at an upper axial end of the annular space, comprising a manifold in the overall shape of a torus arranged along at least part of the circumference of the annular space, at least one feed pipe for the manifold passing through the outer jacket and means for guiding the feedwater downwards towards the annular space, the feedwater supply device providing a perfectly controlled uniform feed to the annular space with a well-defined circumferential distribution while at the same time having a mechanical structure that allows it to withstand feedwater supply surges.

To this end, the torus-shaped manifold has an upper wall traversed by a number of flow openings distributed in the circumferential direction of the manifold, and the means of guiding the feedwater comprise a jacket arranged around at least part of the manifold so as to delimit with the manifold a space in which the water can flow, at least one guide wall extending the jacket downwards and a number of radially-oriented dividing walls dividing the water-flow space into a number of sections following on from one another in the circumferential direction of the manifold.

BRIEF DESCRIPTION OF THE DRAWINGS

In order to make the invention easy to understand, one embodiment of a steam generator according to the invention will now be described by way of example with reference to the appended drawing figures.

DETAILED OF PREFERRED EMBODIMENT

Figure 1:
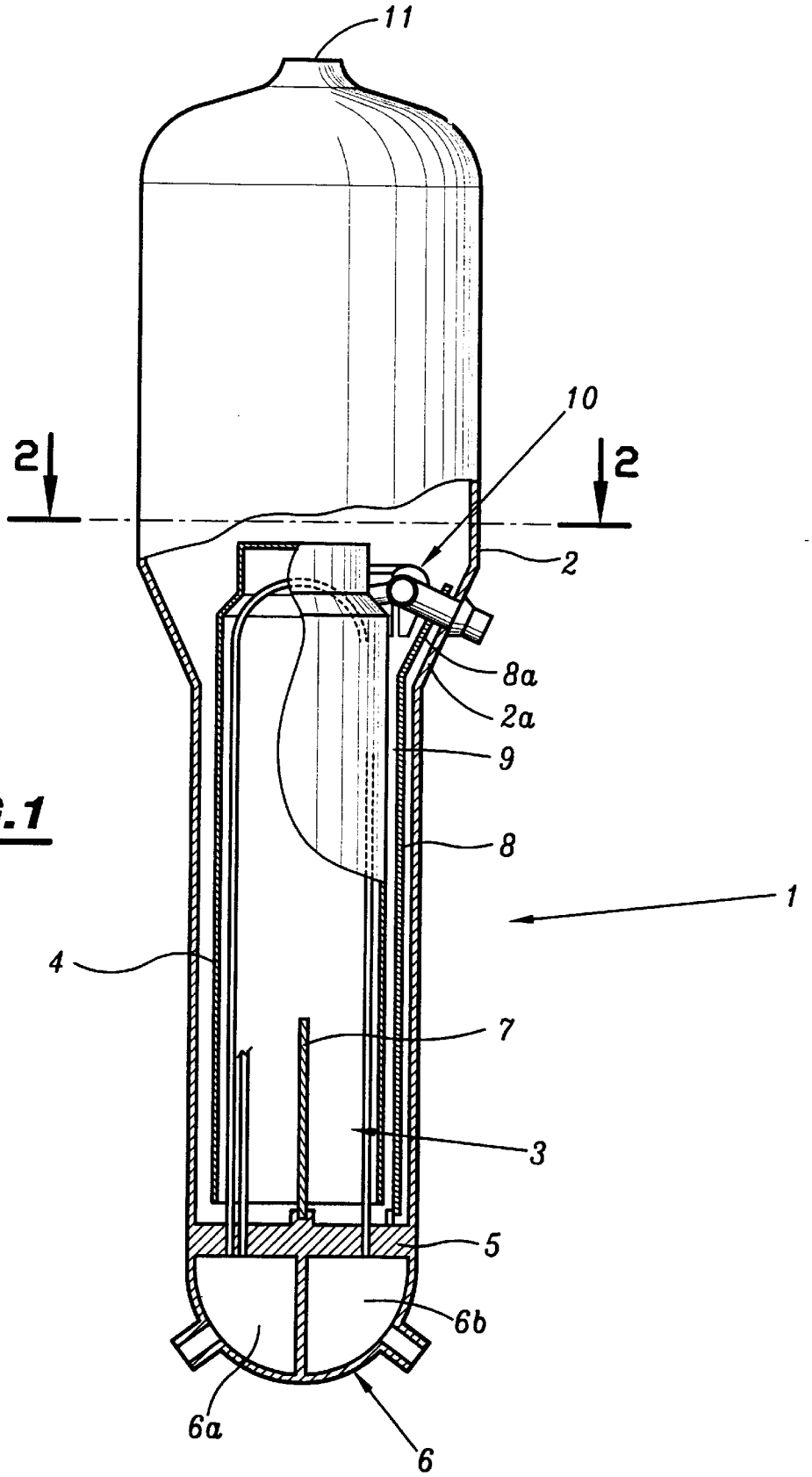
FIG. 1 is a view in elevation, partly in section, on a vertical plane of a steam generator according to the invention.

FIG. 1 shows a steam generator 1 of a pressurized-water nuclear reactor.

The steam generator 1 comprises a cylindrical outer jacket 2 comprising a lower part which has a first diameter and an upper part which has a second diameter greater than the first diameter, the two parts of the outer jacket being joined together by a frustoconical shell 2*a*.

When in service in the nuclear reactor building, the steam generator is arranged vertically, i.e., in such a way that the axis of the outer jacket 2 is vertical.

The steam generator 1 comprises a bundle of heat-exchange tubes 3 arranged inside a bundle wrapper 4 of cylindrical overall shape placed coaxially inside the outer jacket 2 of the steam generator.

The tube bundle 3 consists of bent tubes in the shape of inverted Us, the straight legs of which are fixed at their ends into a tube plate 5 that is integral with the outer jacket 2.

Underneath the tube plate 5 through which the tubes of the bundle 3 pass, there is a water box 6 of hemispherical shape comprising two compartments 6*a* and 6*b* separated from one another by a partition.

Pressurized water for cooling the reactor and coming from the vessel containing the core of the nuclear reactor is introduced into the compartment 6*a* and distributed into the legs of the tubes of the bundle 3 which open into the compartment 6*a,* these legs constituting the hot legs of the bundle 3.

The pressurized water that cools the reactor flows through the tubes of the bundle to reach the compartment 6*b* of the water box into which the cold legs of the tubes of the bundle 3 open. The cooling water which has flowed through the tubes of the bundle 3 is sent back to the nuclear reactor vessel.

A dividing plate 7 between the lower parts of the hot legs and the cold legs of the tubes of the bundle 3 is arranged vertically between the legs of the bundle and is fixed at its bottom to the tube plate 5, in a direction across a diameter of the tube plate.

Between the bundle wrapper 4 and the outer jacket 2 of the steam generator, which are arranged coaxially with respect to each other, there is a feedwater guide skirt 8 in the form of a cylindrical sector of an amplitude of about 180° in the circumferential direction. The upper part 8*a* of the skirt 8 is flared outwards towards the top and has the shape of a frustoconical sector.

The bottom end of the skirt 8 is in contact with the upper face of the tube plate 5.

Between the bundle wrapper 4 and the skirt 8 that guides the steam generator feedwater, there is an annular space 9 in which the steam generator feedwater can flow. The annular space 9 in which the feedwater can flow in an axial direction is closed at its bottom by the tube plate 5.

The lower end of the bundle wrapper 4 is arranged a certain height above the upper face of the tube plate 5, so that the space 9 in which the feedwater flows communicates with that part of the bundle wrapper 4 that contains the lower ends of the cold legs of the tubes of the bundle 3, which part is delimited by the vertical dividing plate 7.

In the upper part of the annular space 9 in which the feedwater flows, between the frustoconical part 8*a* of the skirt 8 and the bundle wrapper 4, is placed a feedwater supply and distribution device 10 which introduces a stream of steam generator feedwater which is distributed in the circumferential direction of the annular space 9 surrounding part of the bundle wrapper 4.

The device 10 which introduces and distributes the feedwater, and which is produced in accordance with the invention, will be described hereinbelow.

The feedwater introduced into the upper part of the annular space 9 flows from the top downwards, in the vertical direction, i.e., in the axial direction of the steam generator, as far as the upper face of the tube plate 5 which constitutes the lower end of the annular space 9. The feedwater then enters the bundle wrapper 4 to come into contact with the lower end part of the cold legs of the tubes of the bundle 3. The feedwater is preheated as it flows through the annular space and in contact with the end parts of the cold legs through which there flows the reactor cooling water which is then collected in the compartment 6*b* of the water box.

The steam generator feedwater reaching the upper edge of the dividing plate 7 comes into contact with the hot legs of the tubes of the bundle 3 through which the pressurized cooling water from the reactor vessel flows. Contact with the hot legs and the upper part of the cold legs of the bundle further heats the feedwater which is rising inside the bundle while at the same time being heated and turned into steam.

The steam formed from the feedwater that has become heated in contact with the bundle leaves the bundle wrapper via its upper end and enters the large-diameter upper part of the outer jacket 2 of the steam generator in which steam separators and dryers are arranged.

The dried steam is sent to the turbine associated with the nuclear reactor via a pipe connected to the nozzle 11 that constitutes the upper part of the outer jacket 2 of the steam generator.

The device 10 for introducing and distributing feedwater must satisfactorily distribute the feedwater around the circumference of the annular space 9.

Figure 2:
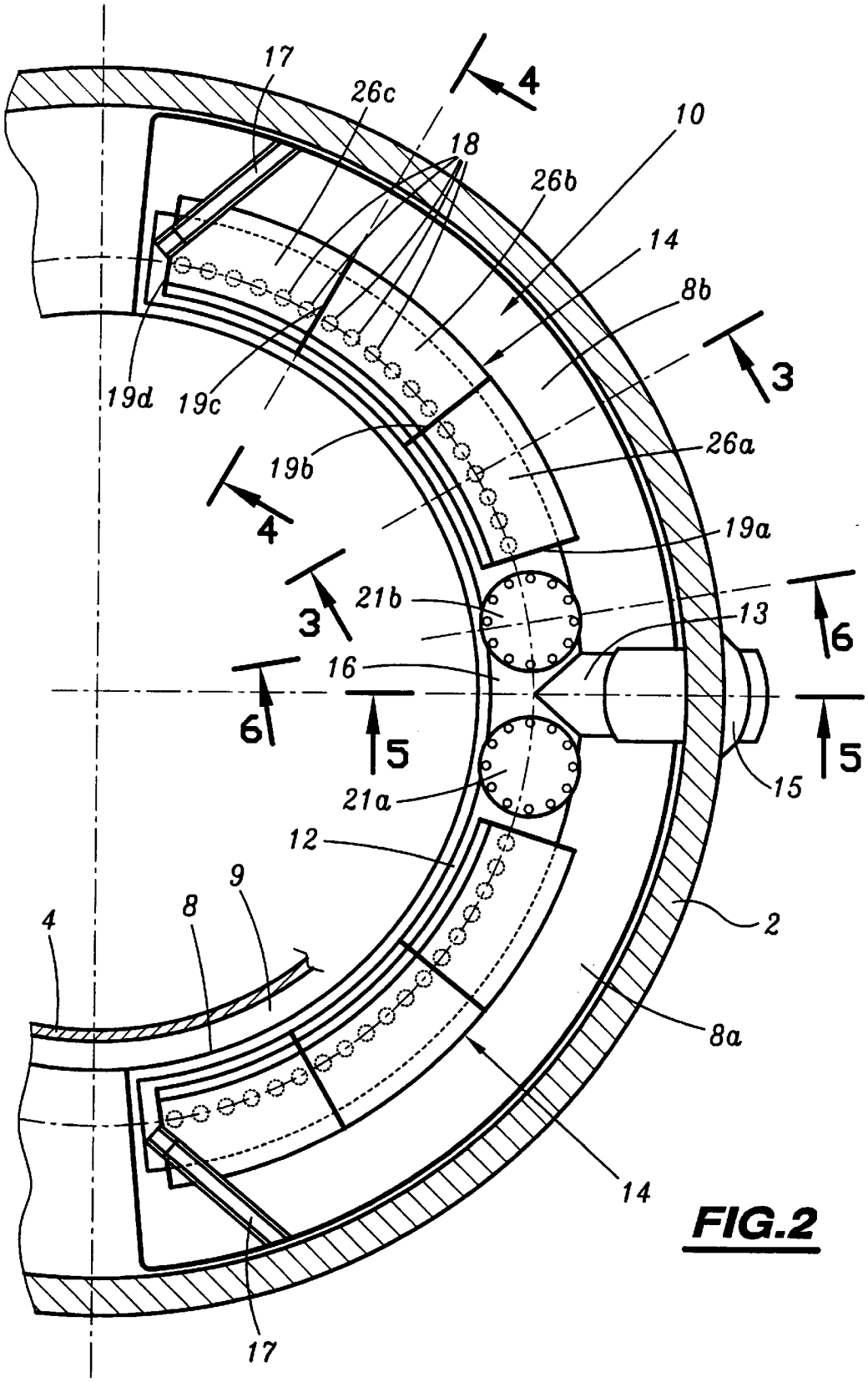
FIG. 2 is a half view in section on a horizontal plane of the steam generator, along line 2—2 of FIG. 1.

FIG. 2 depicts a water introduction and distribution device 10 according to the invention which mainly comprises a manifold 12 in the shape of a portion of a torus extending over a circular arc slightly less than 180°, a pipe 13 for introducing feedwater into the manifold 12 and a two-part assembly 14 for guiding the feedwater downwards towards the annular space 9 delimited between the skirt 8 and the bundle wrapper 4 of the steam generator.

The feedwater inlet pipe 13 is connected to a nozzle 15 that passes through the outer jacket of the steam generator as well as to a central portion 16 of the manifold 12 that is in the shape of a portion of a torus. The manifold 12 consists of a portion of large-diameter torus-shaped pipe fixed by supports 17 to the internal surface of the outer jacket 2 of the steam generator, above the part 8*a* of the skirt 8 in the shape of a frustoconical sector.

The manifold 12, in the shape of a portion of a torus, comprises, towards the top of its wall openings 18, the centers of which are aligned on a circle centered on the axis of the steam generator which is common to the outer jacket 2, the bundle wrapper 4 and the manifold 12. Usually, the successive openings 18, the cross sections of which may differ, are separated from one another by a roughly constant distance, so as to allow uniform distribution of feedwater in the circumferential direction of the manifold 12 which is in the shape of a portion of a torus.

Depending on the desired distribution of water in the circumferential direction of the manifold and of the annular space 9, it is possible to provide openings 18, the dimensions and distributions of which are adapted to suit the particular distribution of feedwater that is to be obtained. This is true even when a uniform distribution is to be obtained.

Figure 3:
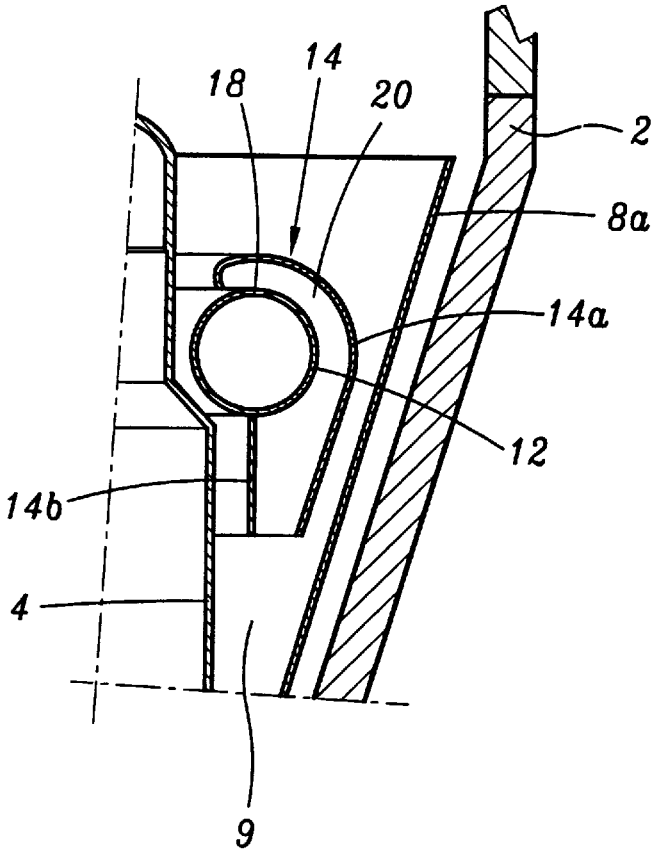
FIG. 3 is a view in section along line 3—3 of FIG. 2.
Figure 4:
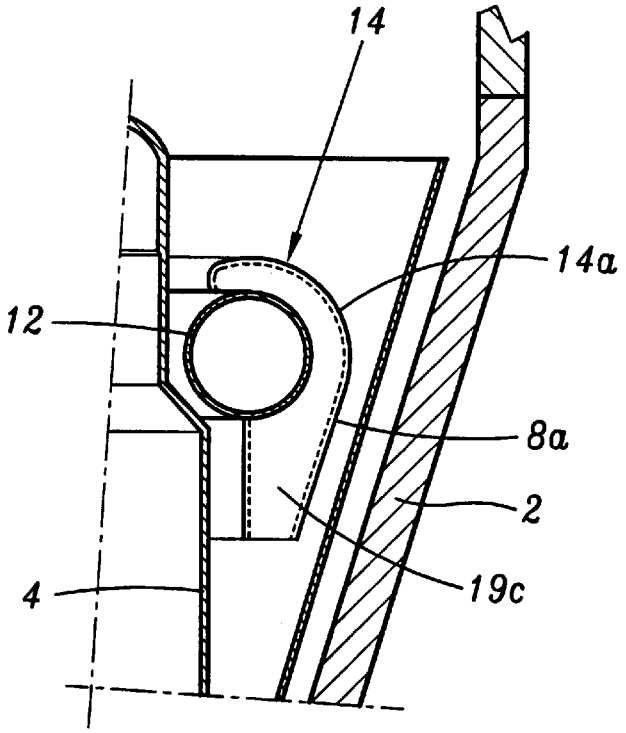
FIG. 4 is a section on along line 4—4 of FIG. 2.

As can be seen in FIGS. 3 and 4, each of the two parts of the feedwater guide device 14 comprises an outer wall 14*a* with a part in the shape of a portion of a torus, the cross section of which roughly corresponds to a quarter of a circular section and a frustoconical part extending the torus-shaped part downwards, roughly parallel to the frustoconical part 8*a* of the skirt 8. The guide device 14 additionally comprises an internal part 14*b* of cylindrical shape facing the lower frustoconical part of the outer wall 14*a* of the guide device. The two parts 14*a* and 14*b* of the guide device are fixed to the manifold 12. The openings 18 passing through the upper wall of the torus-shaped manifold 12 open into a water-flow space 20 delimited between the surface of the manifold 12 and the torus-shaped part 14*a* of the guide device arranged around the wall of the manifold 12.

The guidance assembly 14 is placed coaxially with respect to the manifold 12 and the steam generator. The flow space 20 delimited between two parallel portions of torus-shaped surface is of tubular and annular shape. The space 20 opens into a feedwater outlet space delimited between the outer frustoconical part 14*a* and the inner cylindrical part 14*b* of the guide device 14. The fluid outlet space itself opens vertically in line with the annular feed space 9 of the steam generator.

As can be seen in FIGS. 2 and 4, the two portions of the guide device 14 are each divided into several successive sections (three sections 26*a*, 26*b* and 26*c* are shown in FIGS. 2 and 4) by radial walls such as 19*a*, 19*b*, 19*c* and 19*d*.

The walls 19*b* and 19*c* are dividing walls between two successive sectors of the guide device and the walls 19*a* and 19*d* are walls which close the ends of the portion of the guide device 14. The two portions of the guide device 14 which are arranged symmetrically with respect to the feed pipe 13 of the manifold 12 are produced in the same way.

It can be seen in FIG. 4 that the dividing wall 19*c* has the shape of the cross section of the feedwater flow and outlet spaces of the guidance device. The walls such as 19*c* are welded to the walls of the guidance device.

Figure 5:
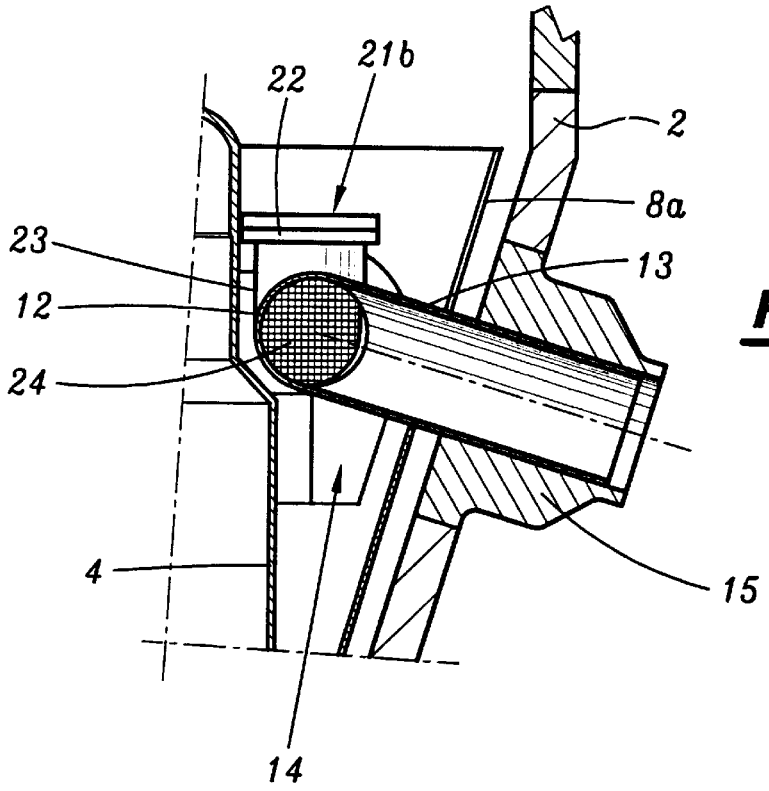
FIG. 5 is a section on along line 5—5 of FIG. 2.
Figure 7:
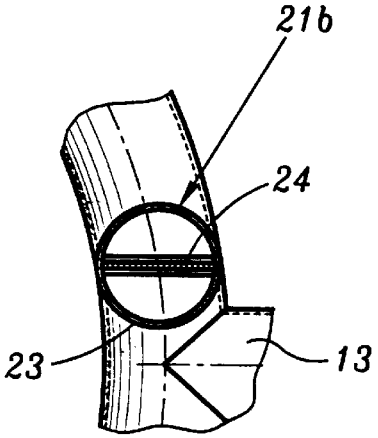
FIG. 7 is a section on along line 7—7 of FIG. 6.

As can be seen in FIG. 5, the feed pipe 13 of the manifold 12 connected to the central section 16 of the manifold opens into the manifold below the upper part of the manifold comprising the openings 18, so as to supply the manifold 12 with feedwater. As can be seen in FIG. 2, two filtration devices 21*a* and 21*b* are placed on the central section of the manifold one on each side of the region where the feed pipe 13 is attached. The two filtration devices 21*a* and 21*b* are produced in exactly the same way, which means that only the filtration device 21*b* depicted in FIGS. 5, 6 and 7 will be described.

The filtration devices are mounted on the upper part of the manifold 12, in the region of openings cut in the wall of the torus-shaped manifold, the shape of which corresponds to the intersection of a cylinder with the torus-shaped surface of the manifold. The filtration device 21*b* comprises a support structure consisting of a cylindrical wall 23 comprising a peripheral flange 22 which will rest on the torus-shaped manifold 12, such that it is coaxial with an opening passing through the wall of the torus-shaped manifold.

The filtration element of the filtration device consists of a flat mesh sheet 24 held within the jacket of the torus-shaped manifold 12, at the opening where the cylindrical wall 23 of the support structure is placed. The means of holding the flat sheet 24 of the filtration element comprise a guide rail of roughly semicircular shape fixed to the internal surface of the torus-shaped wall and a closure plug 25 of circular contour with a diametral slot in which the upper edge of the sheet 24 is engaged. The closure plug 25 has a peripheral flange allowing it to be attached by screws to the peripheral flange 22 of the support assembly. Furthermore, the plug 25 has a shape such that it fills the interior volume of the cylindrical wall 23 of the support assembly so as to prevent there being a dead volume at the top of the support assembly. The filtration sheet 24 has a semicircular end part, the shape and size of which correspond to one half the cross section of the torus 12.

Figure 6:
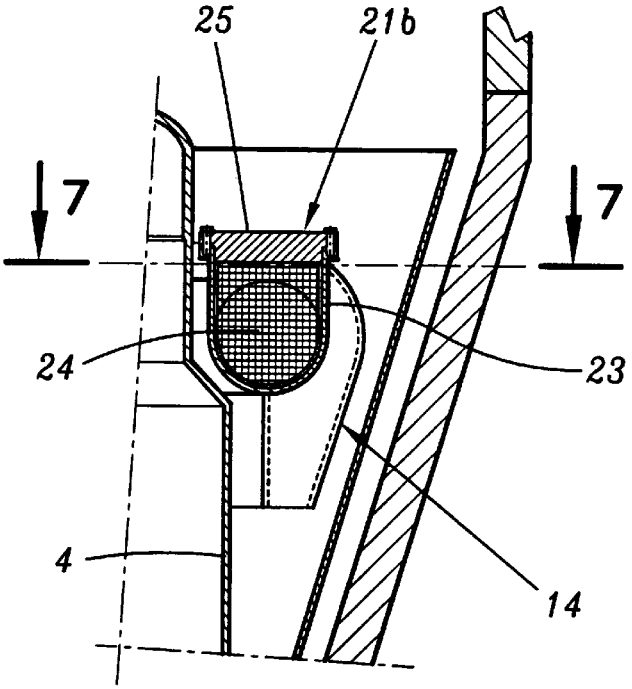
FIG. 6 is a section on along line 6—6 of FIG. 2.

When the filtration device 21*b* is in place in the upper part of the torus, at a through-opening, the filtration sheet 24 penetrates inside the torus so that it completely occupies the cross section of the torus, as can be seen in FIGS. 5 and 6.

Thus, the feedwater introduced through the feed pipe 13, which enters the central section 16 of the manifold 12, has to pass through the filtration walls 24 of the filtration devices 21*a* and 21*b* before filling the two distribution parts of the manifold that are situated one on each side of the central section 16. Thus, the feedwater is filtered so that any migrating bodies contained in the feedwater are stopped in the central inlet space of the manifold and cannot be carried into the two distribution parts of the manifold or into the annular feed space 9 of the steam generator.

The feedwater filling the two distribution parts of the torus, one on each side of the central section 16, flows through the upper openings 18 of the manifold 12 into the flow space 20 and then into the outlet space that lies in the extension of the flow space 20. The feedwater is thus guided downwards towards the annular feed space 9 of the steam generator.

The device according to the invention makes it possible both to obtain optimum distribution of the feedwater in the circumferential direction of the annular feed space of the steam generator, and to obtain a flow in which the turbulence at the exit from the feed device is very restricted because the water is distributed through openings that pass through the torus-shaped jacket of the manifold at its top and because of the presence of the partitioned guidance device.

Furthermore, of the manifold made of a closed torus-shaped jacket is more durable than the spillway in the form of a channel section.

Thus any risk of the formation of vortices at the exit from the feed device in the annular space of the steam generator is avoided.

The passage openings for the water in the torus-shaped manifold are made in such a way as to avoid any risk of the torus-shaped manifold becoming de-watered in the event of a drop of level in the steam generator, which would result in an accumulation of steam in the upper part of the torus-shaped manifold. Such a build-up of steam would be damaging when the feedwater supply installation is started back up after a period of being shut down.

The design of the guidance device in the form of successive sectors separated by radial dividing plates makes this guidance device easier to produce. The presence of radial dividing plates makes it possible to create successive feedwater streams in the circumferential direction and plays a part in improving the stability of the flow. The presence of separate sectors also makes it possible to preserve the same distribution of flow rate at the exit from each of the elemental sectors as exists at the exit from the openings in the manifold.

The mesh size of the grid or mesh that forms the filtration element 24 is such that it will hold back migrating bodies larger than a predetermined size preferably a size smaller than the distance that separates the tubes of the bundle of the steam generator, so as to prevent the migrating bodies that originate from the secondary circuit from becoming wedged between the tubes of the bundle and threatening to damage them.

To improve the filtration capability of the grid or mesh, it is possible to place a metal gauze over the upstream face of the mesh or grid, i.e., over that face of the mesh or grid that faces towards the feedwater inlet.

The use of two filtration meshes placed one on each side of the central feed region of the manifold has the advantage that each mesh filters just half of the feedwater flow rate supplied to the steam generator, which reduces the pressure drop compared to a single mesh. Furthermore, the fact that the filtration element is arranged inside the steam generator allows the support assembly 22, 23 and the plug 25 that closes the filtration element to operate under low pressure, any slight leakage which may occur at the flange being of no great consequence because the leaking feedwater then drops directly into the annular feed space of the steam generator.

The shape of feedwater supply devices of the steam generator may differ from the shape described.

The manifold may have a shape and structure which differ from those described.

In a steam generator with preheating of the type described, the manifold has the shape of a portion of a torus, whereas in a steam generator which does not employ preheating, the manifold may be in the shape of a complete torus placed above the steam generator feed space, around the entire circumference.

The arrangement and size of the feedwater outlet openings in the manifold may differ from those described.

The guide device may also be in a form that differs from the form described and may be unitary or in the form of several successive sections. Likewise, the distribution of the radial dividing walls in the circumferential direction of the guide device may vary.

The invention applies to any steam generator that has an annular space in which feedwater can flow and a device for supplying feedwater at an upper axial end of the annular space in which the feedwater flows.

What is claimed is:

1. A steam generator comprising:

(a) an outer jacket of cylindrical overall shape arranged with its axis vertical;

(b) a bundle of heat-exchange tubes;

(c) a bundle wrapper o f cylindrical overall shape arranged coaxially in side the outer jacket;

(d) an annular space delimited between the bundle wrapper and one of the outer jacket and a guide skirt coaxial with the outer jacket in which the feedwater for the steam generator can flow in the axial direction;

(e) a feedwater supply device at an upper axial end of the annular space, said feedwater supply device comprising:

(i) a manifold having a first jacket in an overall shape of the closed torus arranged along at least part of a circumference of the annular space and having an upper wall comprising a plurality of flow openings distributed in a circumferential direction of the manifold;

(ii) at least one feeding pipe for feeding the manifold passing through the outer jacket; and (f) means for guiding the feedwater downwards towards the annular space comprising:

(i) a second jacket arranged around at least part of said first jacket of the manifold delimiting with said first jacket of the manifold a water flow space in which the feedwater can flow;

(ii) at least one guide wall extending said second jacket downwards; and (iii) a plurality of radially-oriented dividing walls dividing the waterflow space into a number of sections succeeding on another in a circumferential direction of said first jacket of the manifold.

2. The steam generator according to claim 1, wherein the means of guiding the feedwater additionally comprise a cylindrical wall facing the guide wall towards the inside of the steam generator and extending the jacket downwards.

3. The steam generator according to claim 1 comprising a skirt for guiding the feedwater which is coaxial with the outer jacket and the bundle wrapper of the steam generator and arranged between the outer jacket and the bundle wrapper, delimiting with the bundle wrapper the annular space in which the feedwater flows, over part of the periphery of the bundle wrapper, wherein said first jacket of the manifold consists of a portion of a torus arranged above the annular space in which the feedwater flows.

4. The steam generator according to claim 3, wherein the annular feed space, said first jacket of the manifold and said second jacket of the means of guiding the feedwater extend over a circular arc of slightly less than 180°.

5. Steam generator according to claim 3, wherein the feed pipe for the manifold is fixed to a middle section of said first jacket of the manifold, so as to introduce the feedwater into the central section of the manifold, the feedwater then being distributed through two water distribution parts of the said first jacket which are situated on either side of the central section.

6. The steam generator according to claim 5, wherein two filtration devices are arranged in the central section of said first jacket of the manifold, one on each side of the region where the feed pipe meets the central section of said first jacket of the manifold.

* * * * *